US006907343B2

(12) United States Patent
Tsukamoto et al.

(10) Patent No.: US 6,907,343 B2
(45) Date of Patent: Jun. 14, 2005

(54) MALFUNCTION DETECTING SYSTEM OF ENGINE COOLING APPARATUS

(75) Inventors: Toshinori Tsukamoto, Wako (JP); Eisaku Gosyo, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/792,775

(22) Filed: Mar. 5, 2004

(65) Prior Publication Data

US 2004/0181333 A1 Sep. 16, 2004

(30) Foreign Application Priority Data

Mar. 13, 2003 (JP) ..... 2003-067909

(51) Int. Cl.[7] ..... F01P 11/14
(52) U.S. Cl. ..... 701/114; 123/41.08; 73/118.1
(58) Field of Search ..... 701/114; 123/41.08, 123/41.09, 41.1; 73/116, 118.1

(56) References Cited

U.S. PATENT DOCUMENTS 6,200,021 B1 * 3/2001 Mitsutani et al. ..... 374/1
2003/0009276 A1 * 1/2003 Isobe et al. ..... 701/114

FOREIGN PATENT DOCUMENTS

JP 2000-8853 1/2000

* cited by examiner

*Primary Examiner*—Andrew M. Dolinar
(74) *Attorney, Agent, or Firm*—Arent Fox, PLLC

(57) ABSTRACT

In a malfunction detecting system of an engine cooling apparatus constituted as a radiator having a thermostat that opens/closes a communicating passage between the engine and the radiator, estimated coolant temperature is calculated using a thermal load parameter correlated to rise in the coolant temperature after engine starting, whilst an engine standing time period is detected. Then, the detected engine standing time period is compared with a predetermined value and based on a result of comparison, one of preset threshold values including a malfunction discrimination threshold value and a malfunction discrimination execute threshold value is selected. The selected threshold value is then compared with the estimated coolant temperature or a difference between the estimated coolant temperature and the detected coolant temperature, and it is discriminated that the cooling apparatus has malfunctioned, when the estimated coolant temperature or the difference exceeds the malfunction discrimination threshold value. With this, the malfunction can be detected with high accuracy.

12 Claims, 9 Drawing Sheets

MALFUNCTION DETECTING SYSTEM OF ENGINE COOLING APPARATUS

BACKGROUND OF THE INVENTION

1. Field of the Invention

This invention relates to a malfunction detecting system of an engine cooling apparatus, more particularly to a malfunction detecting system of a radiator, still more particularly to a malfunction detecting system of a radiator thermostat.

2. Description of the Related Art

The internal combustion engine of a vehicle is equipped with a radiator (cooling apparatus) for cooling a coolant. The radiator is connected midway of a coolant communicating passage composed of an inlet pipe and an outlet pipe. A thermostat (shut-off valve) is installed in the communicating passage. The thermostat closes the communicating passage when the coolant temperature is low, such as just after engine starting, and opens it as the coolant temperature rises so that the coolant can enter the radiator to be cooled.

Since the radiator is one of the on-board components of a vehicle, it is preferably checked for malfunction. It was for this purpose that the assignee developed a system that first checks whether the engine is in a state cooled to a temperature equal to the outside air temperature (intake air temperature) owing to thorough soaking (long-period or sufficient standing) and whether change in the outside air temperature since engine starting is small, and then, when these conditions are met, determines that the conditions for execution of malfunction detection have been established, whereafter it carries out a calculation for estimating the coolant temperature and determines that the radiator, more precisely the radiator thermostat, has malfunctioned if, for example, the detected coolant temperature has not reached the judge-normal value when the estimated coolant temperature reaches the judge-malfunction value. This technology is described in the assignee's Japanese Laid-Open Patent Application 2000-008853.

The conventional system that discriminates malfunction using the engine coolant temperature and outside air temperature utilizes the intake air temperature indicated by the output of a temperature sensor installed downstream of the throttle valve as the outside air temperature. In other words, the conventional system uses the raw output value of the intake air temperature sensor as the outside air temperature, notwithstanding that these are essentially different and that the state of engine cooling is more affected by the outside air temperature than the intake air temperature.

As shown in FIG. 9, the engine coolant temperature, intake air temperature and outside air temperature all become equal after a sufficient amount of time has elapsed following engine shutdown. Immediately after shutdown, however, the difference between the coolant temperature and the intake air temperature is large, and the difference between the intake air temperature and the outside air temperature is also large. As the graph shows, the temperatures converge with passage of time and finally become the same. When the outside air temperature is detected from the output of a sensor located in the engine compartment, however, the state of engine cooling cannot be accurately ascertained until the temperatures become equal.

SUMMARY OF THE INVENTION

An object of the present invention is therefore to overcome this disadvantage by providing a malfunction detecting system of an engine cooling apparatus that by accurately detecting the state of engine cooling and discriminating malfunction based thereon can detect malfunction of an engine cooling apparatus, more specifically a radiator, still more specifically a thermostat with high accuracy.

In order to achieve the object, the invention provides in its first aspect, a system for detecting malfunction of an engine cooling apparatus constituted as a radiator having a communicating passage connected to an internal combustion engine in such a manner that coolant flows in the radiator to be cooled and a thermostat opening/closing the communicating passage, comprising: engine operation parameter obtaining means for obtaining parameters indicating operating conditions of the engine, including at least a temperature of the coolant of the engine; estimated coolant temperature calculating means for calculating an estimated temperature of the coolant after engine starting based on at least the detected coolant temperature at engine starting and a thermal load parameter correlated to rise in the coolant temperature after engine starting from among of the obtained parameters indicating the operating conditions of the engine; engine standing time period detecting means for detecting a standing time period during which the engine was inoperative prior to the starting; threshold value selecting means for comparing the detected standing time period with a predetermined time period and for selecting at least one of a plurality of preset threshold values based on a result of comparison; and malfunction discriminating means for discriminating whether the cooling apparatus has malfunctioned based on the selected threshold value and at least one of the estimated coolant temperature and the detected coolant temperature.

In order to achieve the object, the invention provides in its second aspect, a system for detecting malfunction of an engine cooling apparatus constituted as a radiator having a communicating passage connected to an internal combustion engine in such a manner that coolant flows in the radiator to be cooled and a thermostat opening/closing the communicating passage, comprising: engine operation parameter obtaining means for obtaining parameters indicating operating conditions of the engine, including at least a temperature of the coolant of the engine; estimated coolant temperature calculating means for calculating an estimated temperature of the coolant after engine starting based on at least the detected coolant temperature at engine starting and a thermal load parameter correlated to rise in the coolant temperature after engine starting from among of the obtained parameters indicating the operating conditions of the engine; engine standing time period detecting means for detecting a standing time period during which the engine was inoperative prior to the starting; malfunction discrimination prohibiting means for comparing the standing time period with a predetermined first time period and for prohibiting malfunction discrimination when the standing time period does not exceed the predetermined first time period; threshold value selecting means for comparing the detected standing time period with a predetermined second time period and for selecting at least one of a plurality of preset malfunction discrimination threshold values based on a result of comparison; temperature comparing means for comparing at least one of the estimated coolant temperature and a difference between the estimated coolant temperature and the detected coolant temperature with the selected malfunction discrimination threshold value; and malfunction discriminating means for discriminating that the cooling apparatus has malfunctioned, when at least one of the estimated coolant temperature and the difference exceeds the selected malfunction discrimination threshold value.

In order to achieve the object, the invention provides in its third aspect, a system for detecting malfunction of an engine cooling apparatus constituted as a radiator having a communicating passage connected to an internal combustion engine in such a manner that coolant flows in the radiator to be cooled and a thermostat opening/closing the communicating passage, comprising: engine operation parameter obtaining means for obtaining parameters indicating operating conditions of the engine, including at least a temperature of the coolant of the engine; estimated coolant temperature calculating means for calculating an estimated temperature of the coolant after engine starting based on at least the detected coolant temperature at engine starting and a thermal load parameter correlated to rise in the coolant temperature after engine starting from among of the obtained parameters indicating the operating conditions of the engine; engine standing time period detecting means for detecting a standing time period during which the engine was inoperative prior to the starting; malfunction discrimination prohibiting means for comparing the standing time period with a predetermined first time period and for prohibiting malfunction discrimination when the standing time period does not exceed the predetermined first time period; threshold value selecting means for comparing the detected standing time period with a predetermined second time period and for selecting at least one of a plurality of preset malfunction discrimination threshold values based on a result of comparison; temperature comparing means for comparing the estimated coolant temperature with the selected malfunction discrimination threshold value; and malfunction discriminating means for discriminating that the cooling apparatus has malfunctioned, when the estimated coolant temperature exceeds the selected malfunction discrimination threshold value.

BRIEF DESCRIPTION OF THE DRAWINGS

The above and other objects and advantages of the invention will be more apparent from the following description and drawings, in which.

DETAILED DESCRIPTION OF THE PREFERRED EMBODIMENT

An embodiment of the invention will now be explained with reference to the attached drawings.

Figure 1:
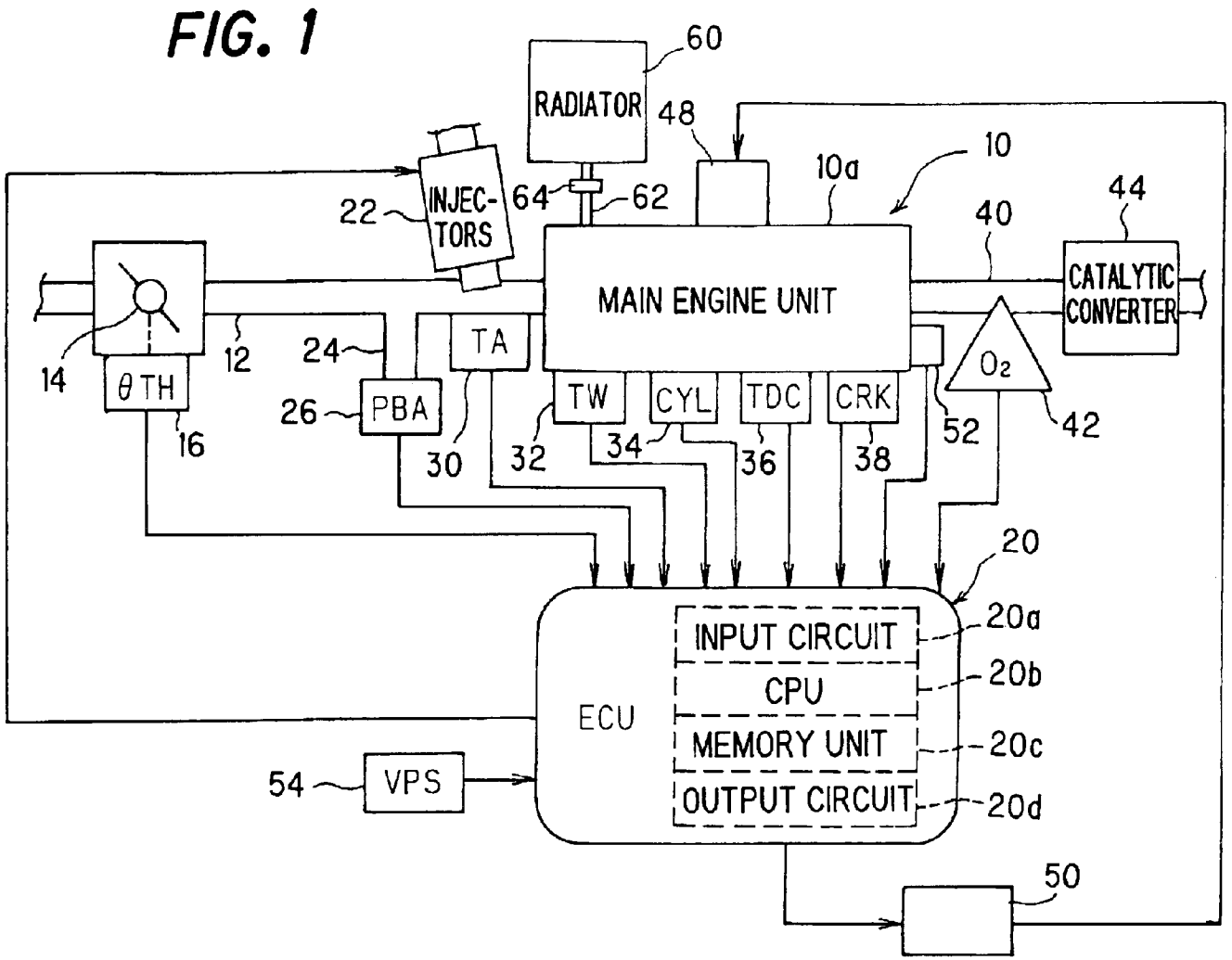
FIG. 1 is a schematic overview of a malfunction detecting system of an engine cooling apparatus (radiator) according to an embodiment of the present invention.

FIG. 1 is a schematic overview of a malfunction detecting of an engine cooling apparatus (radiator) according to an embodiment of the present invention.

Reference numeral 10 in FIG. 1 designates a four-cylinder, four-cycle internal combustion engine. An air intake pipe 12 equipped with a throttle valve 14 is connected to a main engine unit 10*a* of the engine 10. A throttle position sensor 16 coupled with the throttle valve 14 produces and sends to an Electronic Control Unit (ECU) 20 an electric signal representing the opening or position θTH of the throttle valve 14. Downstream of the throttle valve, the air intake pipe 12 forms an intake manifold (not shown). For each cylinder, a fuel injector 22 is provided in the intake manifold at a point upstream of an intake valve (not shown) of the cylinder. The injectors 22 are physically connected to a fuel pump (not shown) that supplies them with pressurized fuel and are electrically connected to the ECU 20. The ECU 20 controls the valve open time of the injectors 22 and each injector 22 injects (supplies) pressurized fuel to the region of the intake valves while open.

A manifold absolute pressure sensor 26 connected with the air intake pipe 12 through a branch pipe 24 downstream of the throttle valve 14 produces an electric signal representing the manifold absolute pressure PBA in the air intake pipe 12 (indicative of engine load). An outside air temperature (intake air temperature) sensor 30 attached to the air intake pipe 12 downstream of the manifold absolute pressure sensor 26 outputs an electric signal representing the intake air temperature TA. A coolant temperature sensor 32 installed near a coolant passage (not shown) of the main engine unit 10*a* outputs an electric signal representing the engine coolant temperature TW.

A cylinder discrimination sensor 34 installed near the camshaft or crankshaft (neither shown) of the engine 10 outputs a cylinder discrimination signal CYL every time the piston of a certain cylinder reaches a prescribed position. A TDC sensor 36 installed near the camshaft or crankshaft (neither shown) outputs a TDC signal pulse once every crankangle (e.g., BTDC 10 degrees) associated with the TDC (Top Dead Center) position of the piston (not shown) of each cylinder. A similarly installed crankangle sensor 38 outputs CRK pulse signals at a shorter crankangle period (e.g., every 30 degrees) than the period of the TDC signal pulses.

In the exhaust system of the engine 10, an air/fuel ratio ($O_2$) sensor 42 is installed at an appropriate portion of an exhaust pipe 40 connected to the exhaust manifold (not shown). The air/fuel ratio sensor 42 outputs a signal representing the oxygen concentration 02 of the exhaust gas. A three-way catalytic converter 44 provided downstream of the air/fuel ratio sensor 42 removes HC, CO and NOx components from the exhaust gas.

Spark plugs 48 associated with the respective combustion chambers (not shown) of the engine 10 are electrically connected to the ECU 20 through an ignition coil and ignitor (collectively designated by reference numeral 50). A knock sensor 52 mounted on the cylinder head (not shown) of the main engine unit 10*a* outputs a signal representing vibration of the engine 10. Further, a vehicle speed sensor 54 mounted in the vicinity of the drive shaft (not shown) of the vehicle powered by the engine 10 outputs a pulse once every unit rotation of the vehicle wheels.

The outputs of these sensors are sent to the ECU 20. The ECU 20, which is constituted as a microcomputer, comprises an input circuit 20*a* for receiving input signals from the aforesaid sensors and subjecting them to wave shaping, conversion to a prescribed voltage level and conversion from analog to digital form, a CPU (Central Processing Unit) 20*b* for conducting logical operations, a memory unit 20*c* for storing processing programs executed by the CPU, processed data and the like, and an output circuit 20*d*. The ECU has an off-timer that measures the passage of time since stoppage of the engine 10.

The output of the knock sensor 52 is sent to a detection circuit (not shown) in the ECU 20, where it is compared with a knock discrimination level obtained by amplifying the noise level (calculated by averaging the sensor outputs). The CPU 20*b* uses the output of the detection circuit to discriminate whether knock occurs in the combustion chambers. The CPU 20*b* also calculates the engine speed NE from the counted number of CRK signal pulses and calculates the vehicle speed VPS from the counted number of output pulses by the vehicle speed sensor 54.

The CPU 20*b* also retrieves a basic ignition timing from predefined mapped data stored in the memory unit 20*c* using the detected engine speed NE and the manifold absolute pressure PBA (an engine load parameter) as address data, adjusts the basic ignition timing based on the engine coolant temperature TW etc., and further retards the basic ignition timing if engine knock has been detected. The CPU 20*b* also determines the fuel injection quantity in terms of injector open time and drives the injectors 22 through the output circuit 20*d* and a drive circuit (not shown).

A radiator (cooling apparatus) 60 is connected to the engine 10.

Figure 2:
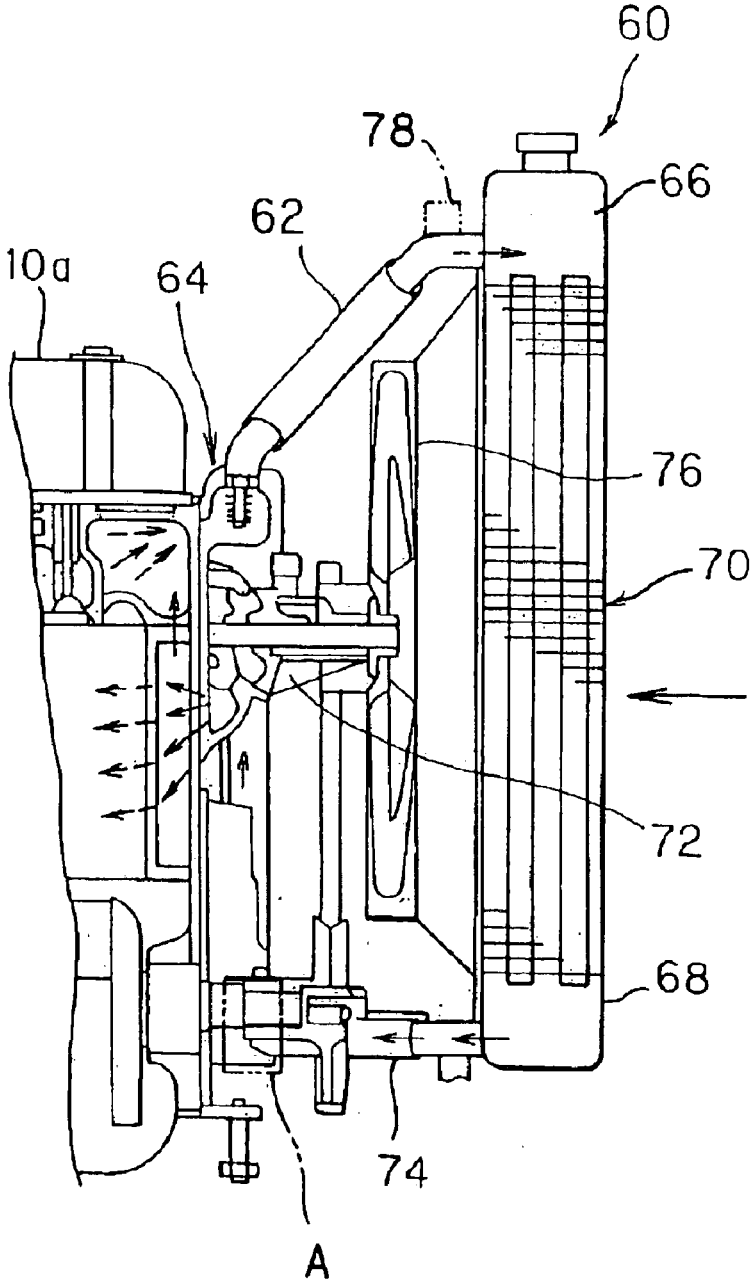
FIG. 2 is an explanatory side sectional view showing the details of a radiator illustrated in FIG. 1.

FIG. 2 is an explanatory side sectional view showing the details of the radiator 60.

As illustrated, the radiator 60 is connected to the engine main unit 10*a* through an inlet pipe (communicating passage) 62. A thermostat 64 is fitted in the inlet pipe 62. The radiator 60 has an upper tank 66 at the top, a lower tank 68 at the bottom, and a honeycomb core 70 accommodated in the intervening space. The inlet pipe 62 is connected to the upper tank 66 and an outlet pipe 74 is connected to the lower tank 68. A water pump 72 pressurizes coolant in the coolant passage of the engine unit 10*a* so as to circulate it through the inlet pipe 62, the upper tank 66, the core 70, the outlet pipe 74 and back to the coolant passage of the engine unit 10*a*. Although not illustrated, a branch pipe for supplying hot coolant to the core of a passenger compartment heater is led off from the inlet pipe 62 or a point upstream thereof. As indicated by an arrow in FIG. 2, the core 70 is cooled by air flowing in from the direction opposite to the direction of vehicle travel. A forced flow of cooling air is further produced by a fan 76 located behind the radiator and driven by the engine.

The thermostat 64 is a shut-off valve operated by a bimetallic strip. At engine starting, when the coolant temperature is low, the thermostat 64 closes the inlet pipe 62 to prevent coolant from flowing into the radiator 60. Then, as the coolant temperature rises, it progressively opens the inlet pipe 62 so that the coolant flows in contact with the core 70 to be cooled and is then returned to the engine coolant passage.

As explained further later, in the foregoing arrangement, the ECU 20 detect malfunction of the radiator (cooling apparatus) 60, more specifically malfunction of the thermostat 64, still more specifically open-state sticking of the thermostat 64.

The mode of operation of the malfunction detecting system according to this embodiment will now be explained with reference to the flow chart of FIG. 3. The illustrated program goes into operation when an ignition switch is turned on and is thereafter executed at regular intervals of, for example, 2 sec.

In S10, the time (time period or period of time) during the engine 10 was inoperative prior to starting (standing time period TS) is detected or ascertained. This is accomplished by reading the value of the off-timer. To be more explicit, the execution of the program of FIG. 3 is started when the ignition switch is turned on after being once turned off to stop the engine 10, and S10 detects the standing time period TS by reading the value of the off-timer.

Next, in S12, a check is made as to whether the detected standing time period TS exceeds a first predetermined time period TREF1 (e.g., 2 hours). When the result is No, the bit of a malfunction discrimination enable flag is reset to 0 in S14 and discrimination or judgment regarding malfunction is reserved in S16. Setting the bit of this flag to 0 means that malfunction discrimination is not enabled (is prohibited).

When the result in S12 is Yes, a check is made in S18 as to whether the detected standing time period TS exceeds a second predetermined time period TREF2 (e.g., 5 hours). When the result in S18 is No, a malfunction discrimination threshold value A (e.g., 10° C.) is selected in S20, the bit of the malfunction discrimination enable flag is set to 1 in S22, and the detected intake air temperature TA is substituted for or renamed as the outside air temperature in S24. When the result in S18 is Yes, a malfunction discrimination threshold value B (e.g., 5° C.) is selected in S26, the bit of the malfunction discrimination enable flag is set to 1 in S28, and the detected intake air temperature TA is substituted for or renamed as the outside air temperature in S30. Setting of the bit of the flag to 1 means that malfunction discrimination is enabled (permitted). The reason for substituting the intake air temperature TA for the outside air temperature in S24 and S30 is that this embodiment is not equipped with an outside air temperature sensor, but the outside air temperature is used in a calculation for estimating the coolant temperature explained later.

Figure 9:
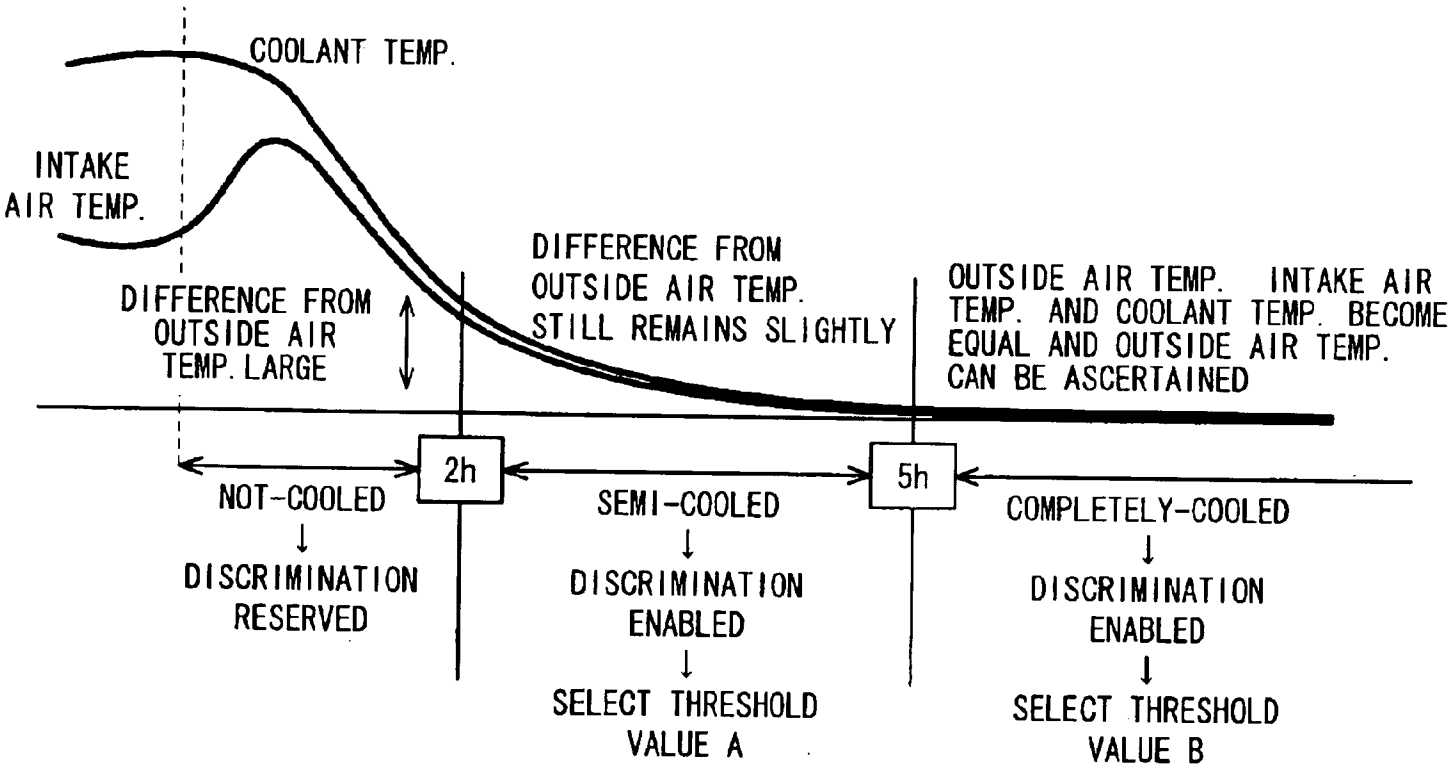
FIG. 9 is a time chart showing the change with passage of time of various temperatures including the coolant temperature relative to the cooling state of a vehicle.

The significance of this processing will be explained. As was mentioned earlier with reference to FIG. 9, when a sufficient period has passed after the engine was stopped, the coolant temperature TW, intake air temperature TA and outside air temperature become the same. Immediately after engine shutdown, however, the difference between the coolant temperature TW and the intake air temperature TA is large, and the difference between the intake air temperature TA and the outside air temperature is also large. Although these temperatures approach converge with passage of time, the state of engine 10 cooling cannot be accurately ascertained until the temperatures completely converge (become equal) when the outside air temperature is detected from the output of the air temperature sensor 30 located downstream of the throttle valve in the engine compartment.

In this embodiment, therefore, malfunction discrimination is prohibited and discrimination or judgment regarding malfunction is reserved (malfunction diagnosis is suspended) when the standing time period TS has not yet exceeded the first predetermined time period TREF1 (2 hours), because under such a condition it can be judged that the engine 10 has not thoroughly cooled and that the difference between the coolant temperature TW and the intake air temperature TA is large.

When the standing time period TS has exceeded the first predetermined time period TREF1 (2 hours), it is compared with the second predetermined time period TREF2 (5 hours). If it has not exceeded the second predetermined time period, the malfunction discrimination threshold value is set to 10° C. based on the judgment that the coolant temperature TW, intake air temperature TA and outside air temperature still differ and that some difference still exists between the intake air temperature TA and the outside air temperature, i.e., that the engine 10 is in a semi-cooled state (short of a completely cooled state). On the other hand, when the standing time period TS has exceeded the second predetermined time period, the malfunction discrimination threshold value is set to 5° C. based on the judgment that there is no difference among the coolant temperature TW, intake air temperature TA and outside air temperature, i.e., that the engine 10 has completely cooled.

Figure 4:
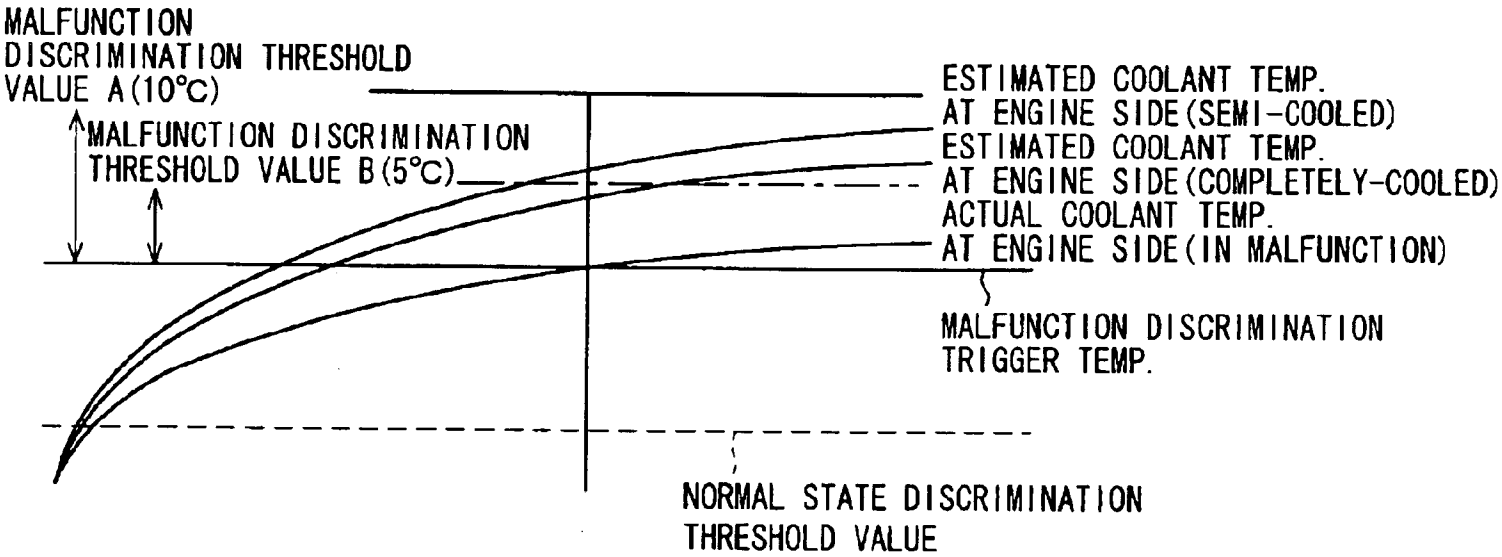
FIG. 4 is a time chart showing the characteristics of malfunction discrimination threshold values A and B, etc., to be used in the processing of the flow chart of FIG. 3.

The malfunction discrimination threshold values A and B are shown in FIG. 4. As illustrated, the malfunction discrimination threshold value A is set higher than (on the high temperature side of) the malfunction discrimination threshold value B. In this embodiment, one of two (i.e., a plurality of) threshold values A, B is selected in accordance with the standing time period TS of the engine 10 and malfunction discrimination is conducted in the manner explained later using the selected value. As shown in FIG. 4, the malfunction discrimination threshold values A, B represent differences from the coolant temperature TW (designated "Actual coolant temp. in FIG. 4).

The characteristic curves shown in FIG. 4 will now be explained. When the thermostat 64 of the radiator 60 is operating normally, the thermostat 64 remains closed to keep the inlet pipe 62 blocked from the time that the engine 10 starts to the time it warms up. Since the coolant present in the radiator 60 is therefore confined to circulation inside the radiator 60, warm-up of the engine 10 is promoted.

Then, as the engine 10 warms up and the coolant temperature TW increases to a certain level, the thermostat 64 opens to let the engine coolant flow into the radiator 60 through the inlet pipe 62 and be cooled while circulating therein. The resulting cooled radiator coolant flows into the engine 10 through the outlet pipe 74 to serve as engine coolant for cooling the engine 10.

If the thermostat 64 should malfunction, specifically if it should experience open-state sticking, the engine coolant will flow into the inlet pipe 62 from immediately after engine starting, resulting in an overcooled state and the coolant temperature will rise only gradually. As explained in further detail later, this embodiment is configured to calculate the thermal (heat) load of the engine 10, calculate cooling loss from the outside air temperature and the like, and estimate rise in coolant temperature TW (when the thermostat is normal) by subtracting the calculated cooling loss from the calculated thermal load. However, in the semi-cooled state of the engine 10, when the cooling loss is small, the estimated value is liable to be high owing to the use of the outside air temperature (initial air intake temperature) to calculate the cooling loss.

This is because the cooling loss at the time of estimation is given by the difference between the current coolant temperature and the outside air temperature and increases as this difference increases, so that in the semi-cooled state, when the measured value of the outside air temperature is likely to be higher than the actual value, the cooling loss estimated through calculation is liable to be wrong on the high side. Therefore, in this embodiment, erroneous discrimination is prevented by setting the semi-cooled state malfunction discrimination threshold value A higher than the cooled state malfunction discrimination threshold value B. Thus, in this embodiment, the standing time period TS of the engine 10 is detected, a determination as to whether to permit or prohibit malfunction discrimination is made accordingly, and when malfunction discrimination is permitted, one or the other of the malfunction discrimination threshold values A and B is selected, also in accordance with the standing time period TS. This enables the state of engine 10 cooling to be accurately determined and the malfunction discrimination threshold value to be set to a value ensuring accurate discrimination. As a result, malfunction discrimination can be achieved with high accuracy.

Figure 3:
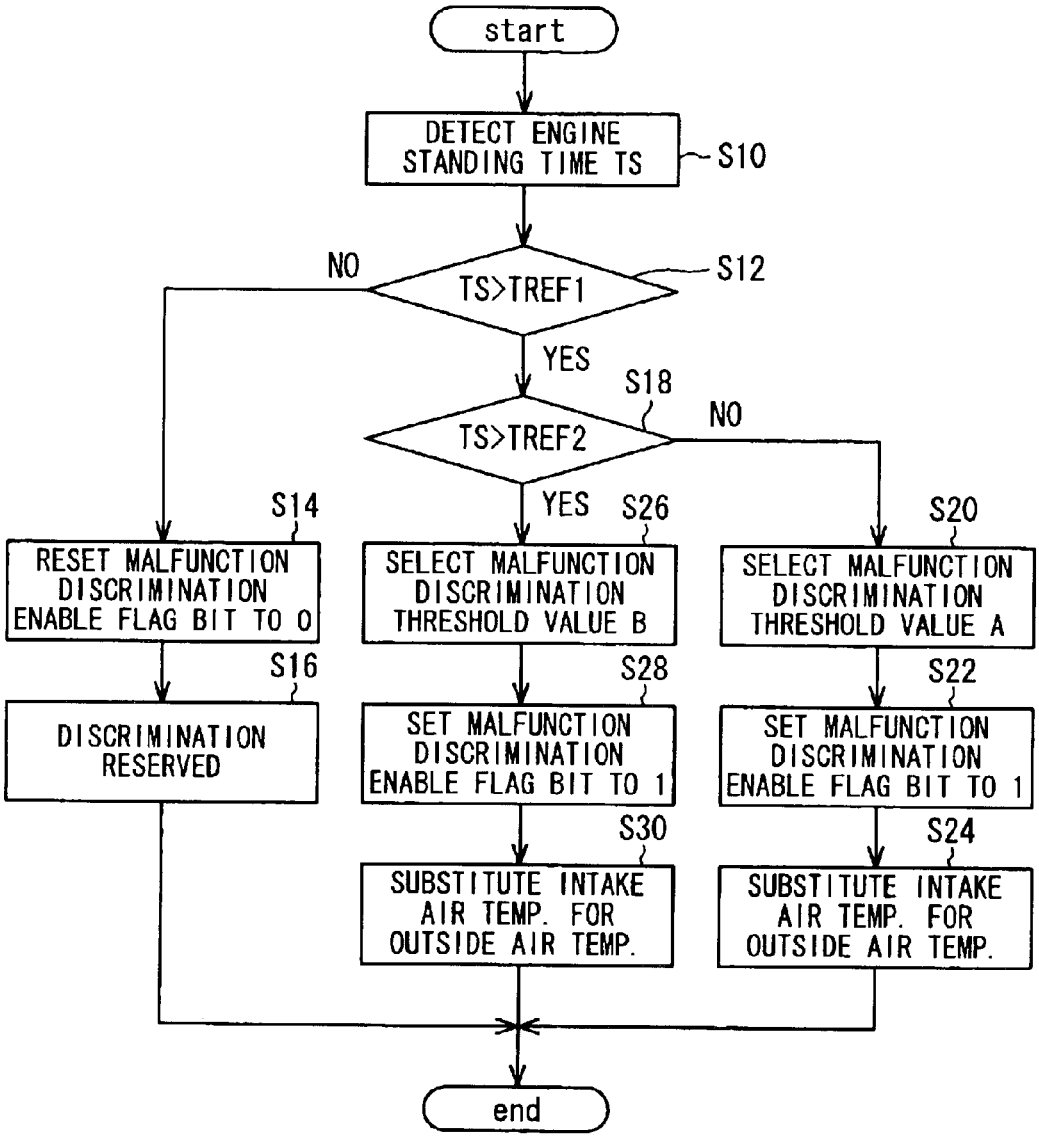
FIG. 3 is a flow chart showing the mode of operation of the malfunction detecting system of an engine cooling apparatus according to the embodiment.
Figure 5:
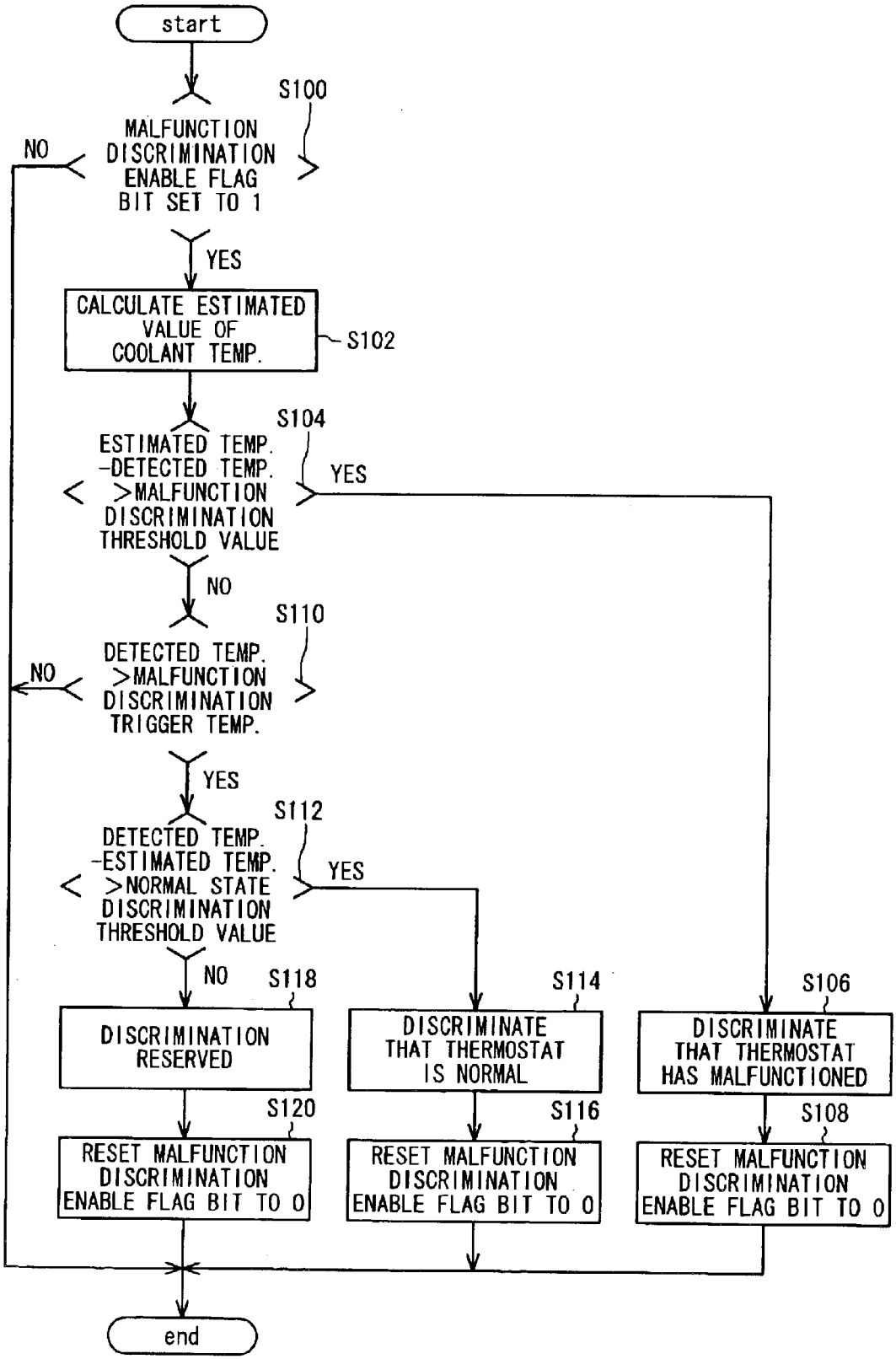
FIG. 5 is a flow chart for explaining another operation of the malfunction detecting system according to the embodiment, which is conducted in parallel with the sequence of operations of the flow chart shown in FIG. 3.

FIG. 5 is a flow chart for explaining a sequence of operations of the malfunction detecting system according to this embodiment, which is conducted in parallel with the sequence of operations of the flow chart shown in FIG. 3. The illustrated program goes into operation when an ignition switch is turned on and is thereafter executed at regular intervals of, for example, 2 sec.

In S100, it is checked whether the bit of the aforesaid flag is set to 1. When the result is No, the remaining steps are skipped, and when it is Yes, the calculation for estimating the coolant temperature is performed in S102. This estimation is for calculating an estimated value of the coolant temperature TW. The calculation in S102 is carried out by the method taught in the assignee's Japanese Laid-Open Patent Application No. 2000-008853.

The technique taught in this publication will be briefly explained. The estimated coolant temperature is calculated based on at least the detected value of the coolant temperature TW at engine starting and a thermal load parameter (coolant estimation base value) correlated to the rise in coolant temperature TW after engine starting. More specifically, the integrated engine load value is calculated from the fuel injection quantity etc., the integrated cooling loss value is calculated by using the difference between the detected value of the coolant temperature TW at engine starting and the outside air temperature to integrate the passenger compartment heater cooling loss, airflow cooling loss (generated by running) and the like, the result is subtracted from the integrated engine load value, and the difference is defined as the thermal load parameter correlated to the coolant temperature TW rise after engine starting. Next, the thermal load parameter is used to calculate the coolant estimation base value, the coolant estimation base value is multiplied by an engine start time coolant correction coefficient for coolant temperature estimation, and the product is added to the detected value of the coolant temperature TW at engine starting to obtain the estimated coolant temperature (estimated value of the coolant temperature TW).

Next, in S104, it is checked whether the difference obtained by subtracting the detected water temperature from the estimated coolant temperature (difference between the estimated value of the coolant temperature TW and the detected value thereof (actual water temperature shown in FIG. 4)) exceeds the malfunction discrimination threshold value, i.e., the malfunction discrimination threshold value A or B selected in the flow chart of FIG. 3. When the result is Yes, it is then discriminated or judged in S106 that the cooling apparatus (radiator) 60 has malfunctioned, more specifically that the thermostat 64 has malfunctioned, still more specifically that the thermostat 64 is stuck open. Next, in S108, because the discrimination has been completed, the bit of the malfunction discrimination enable flag is reset to 0 and the ensuing processing is skipped.

When the result in S104 is No, a check is made in S110 as to whether the detected coolant temperature TW is higher than a malfunction discrimination trigger temperature (malfunction discrimination execute threshold value). When the result is No, the ensuing processing steps are skipped, and when it is Yes, a check is made in S112 as to whether the difference obtained by, oppositely from the operation in S104, subtracting the estimated value of the coolant temperature TW from the detected value TW of the coolant temperature exceeds a normal state discrimination threshold value (see FIG. 4). When the result is Yes, it is then discriminated or judged in S114 that the cooling apparatus (radiator) is normal, more specifically that the thermostat is normal, whereafter the bit of the aforesaid flag is reset to 0 in S116. Thus the malfunction discrimination trigger temperature (malfunction discrimination execute threshold value) serves as a threshold value for the malfunction discrimination, more exactly, for discriminating whether or not the engine cooling apparatus is normal.

When the result in S112 is No, discrimination or judgment regarding malfunction is reserved in S118 and the bit of the aforesaid flag is reset to 0 in S120. The reason for reserving discrimination or judgment in S118 is that, on the one hand, it cannot be readily concluded that malfunction occurred, because the difference obtained by subtracting the detected value from the estimated value did not exceed the malfunction discrimination threshold value, while, on the other hand, it also cannot be concluded that the condition is normal, because the difference obtained by subtracting the estimated value from the detected value did not exceed the relatively low value of the normal state discrimination threshold value. Reserving judgment in this manner makes it possible to avoid erroneous detection.

As explained in the foregoing, this embodiment is configured to detect the standing time period of the engine 10, determines whether to allow or disallow malfunction discrimination based on the detected standing time period, and, when malfunction discrimination is allowed, to select either the malfunction discrimination threshold value A or the malfunction discrimination threshold value B, also in accordance with the standing time period. Since the state of engine 10 cooling can therefore be accurately detected, the cooling apparatus (radiator) 60 can be diagnosed for malfunction with high precision.

A malfunction detecting system of an engine cooling apparatus according to a second embodiment will now be explained with reference to the flow chart of FIG. 6, which is similar to the flow chart of FIG. 3. The illustrated program goes into operation when an ignition switch is turned on and is thereafter executed at regular intervals of, for example, 2 sec.

In this second embodiment, a temperature sensor 78 is installed at an appropriate location on the inlet pipe 62 downstream of the thermostat 64 as illustrated by a chain-dot line in FIG. 2 and outputs an electric (detection) signal representing the temperature of the coolant flowing through at least one of the inlet pipe 62 and outlet pipe 74 (more specifically, the inlet pipe 62 in the illustrated configuration) This temperature is referred to as the "radiator coolant temperature TR." The output of the temperature sensor 78 is sent to the ECU 20.

Similarly to in the first embodiment, in S200, the period that the engine 10 was inoperative prior to starting (standing time period TS) is detected. Next, in S202, a check is made as to whether the detected standing time period TS exceeds the first predetermined time period TREF1. When the result is No, the bit of a malfunction discrimination enable flag is reset to 0 in S204 and discrimination or judgment regarding malfunction is reserved in S206.

When the result in S202 is Yes, a check is made in S208 as to whether the detected standing time period TS exceeds the second predetermined time period TREF2. When the result in S208 is No, a malfunction discrimination trigger temperature difference (malfunction discrimination execute threshold value) A (e.g., 40° C.) is selected in S210, the bit of the malfunction discrimination enable flag is set to 1 in S212 and the intake air temperature TA is substituted for or renamed as the outside air temperature in S214. When the result in S208 is Yes, a malfunction discrimination trigger temperature difference (malfunction discrimination execute threshold value) B (e.g., 35° C.) is selected in S216, the bit of the malfunction discrimination enable flag is set to 1 in S218, and the detected intake air temperature TA is substituted for or renamed as the outside air temperature in S220

The significance of this processing will be explained. As was explained earlier, the relationship among the coolant temperature TW, intake air temperature TA and outside air temperature changes with standing time period of the engine 10. Therefore, also in this second embodiment, discrimination or judgment is reserved (malfunction diagnosis is suspended) when the standing time period TS has not yet exceeded the first predetermined time period TREF1 (2 hours). When the standing time period TS has exceeded the first predetermined time period TREF1 (2 hours), it is compared with the second predetermined time period TREF2 (5 hours). When it has not exceeded the second predetermined time period (5 hours), this is taken to indicate that differences are still present among the coolant temperature TW, intake air temperature TA and outside air temperature and that some difference still exists between the intake air temperature TA and the outside air temperature, i.e., that the engine 10 is in a semi-cooled state (short of a completely cooled state), and the malfunction discrimination trigger temperature difference is set to A (40° C.). On the other hand, when the standing time period TS has exceeded the second predetermined time period, this is taken to indicate that there is no difference among the coolant temperature TW, intake air temperature TA and outside air temperature, i.e., that the engine 10 has completely cooled, and the malfunction discrimination trigger temperature difference is set to B (35° C.).

Figure 7:
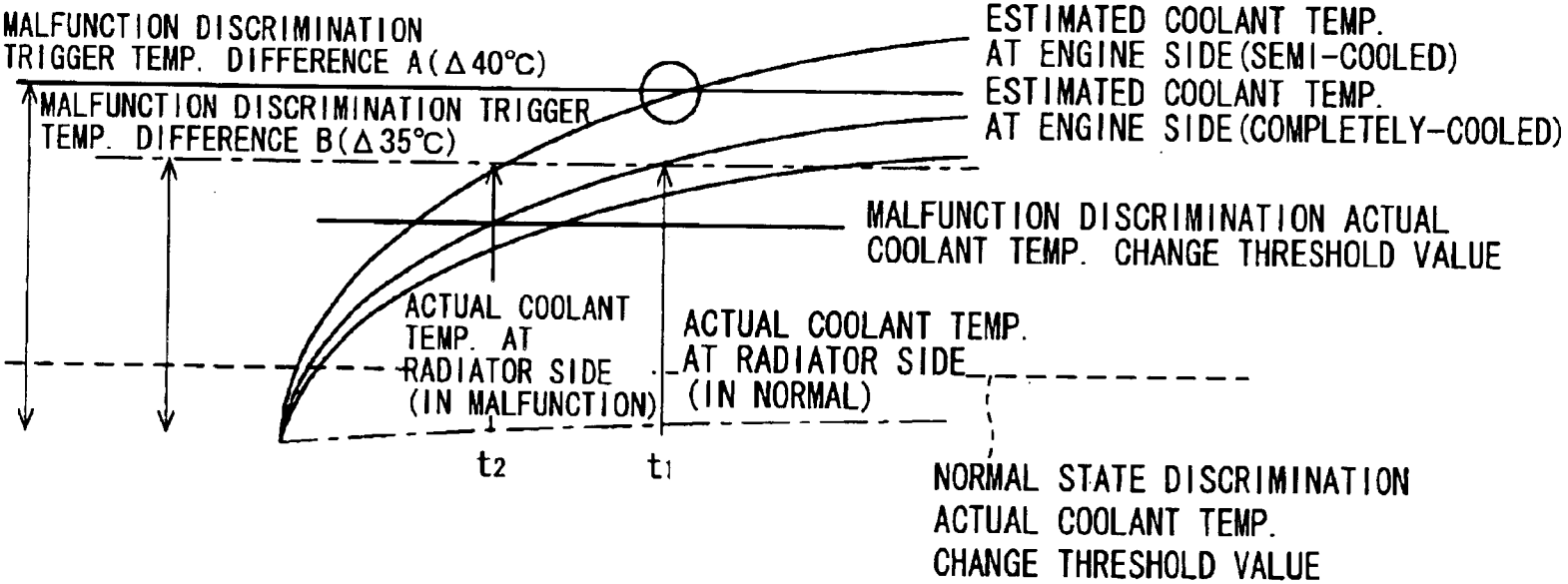
FIG. 7 is a time chart showing the characteristics of malfunction discrimination trigger temperature differences A and B, etc., to be used in the processing of the flow chart of FIG. 6.

FIG. 7 shows the malfunction discrimination trigger temperature differences A and B. In this second embodiment, one of the two (a plurality of) malfunction discrimination trigger temperature differences A, B is selected in accordance with the standing time period TS of the engine 10 and the selected value is compared with the estimated coolant temperature (estimated value of the coolant temperature TW) to determine whether or not to conduct malfunction discrimination. As shown in FIG. 7, for the same reason as explained with reference to the first embodiment, the malfunction discrimination trigger temperature difference A selected when the engine 10 is found to be in the semi-cooled state is set higher than (on the high temperature side of) the malfunction discrimination trigger temperature difference B. As also shown in the figure, the malfunction discrimination trigger temperature differences A, B represent differences from the radiator coolant temperature TR (designated "Actual coolant temp. in FIG. 7).

Figure 6:
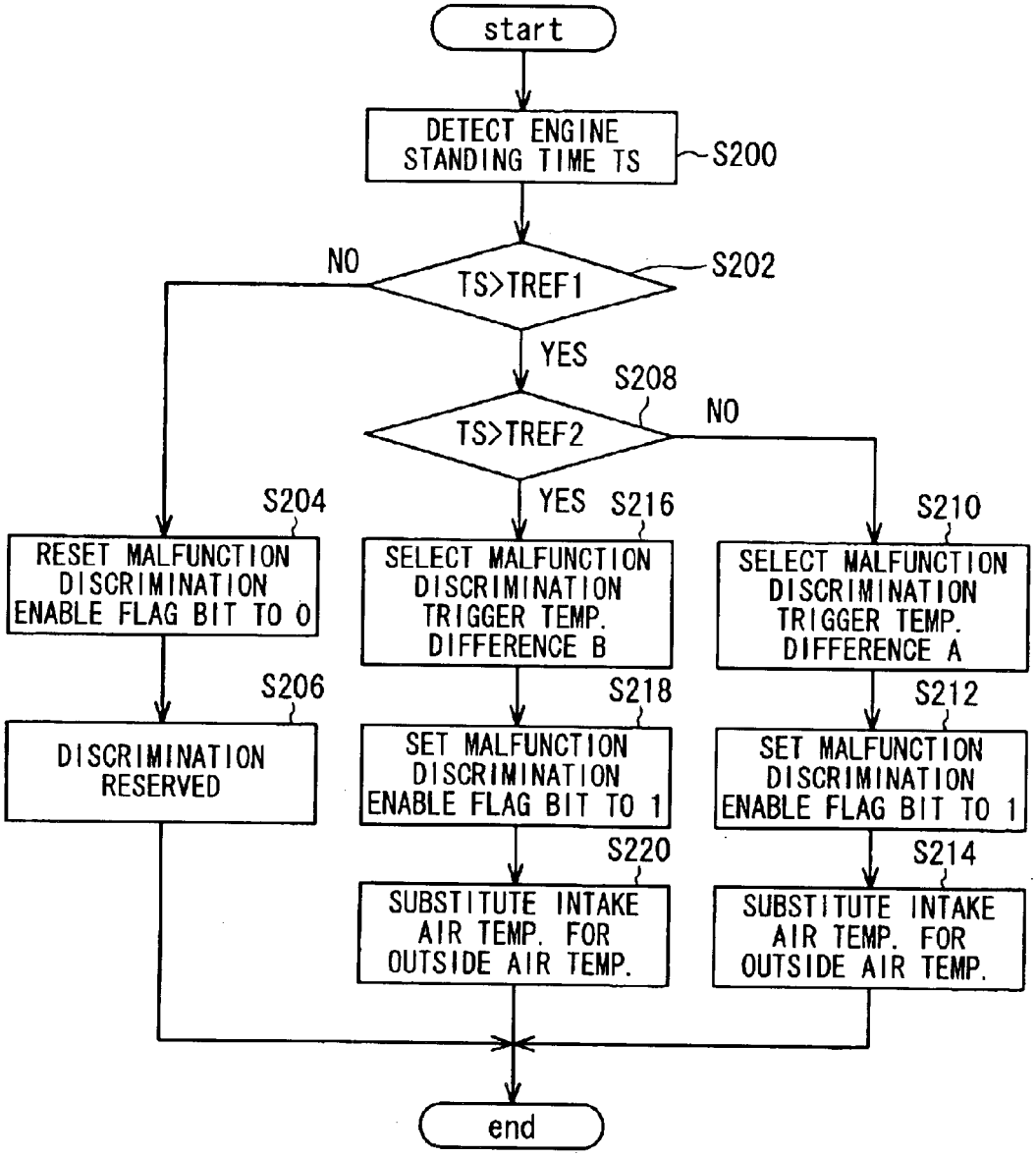
FIG. 6 is a view, similar to FIG. 3, but showing the operation of a malfunction detecting system of an engine cooling apparatus according to a second embodiment of the invention.
Figure 8:
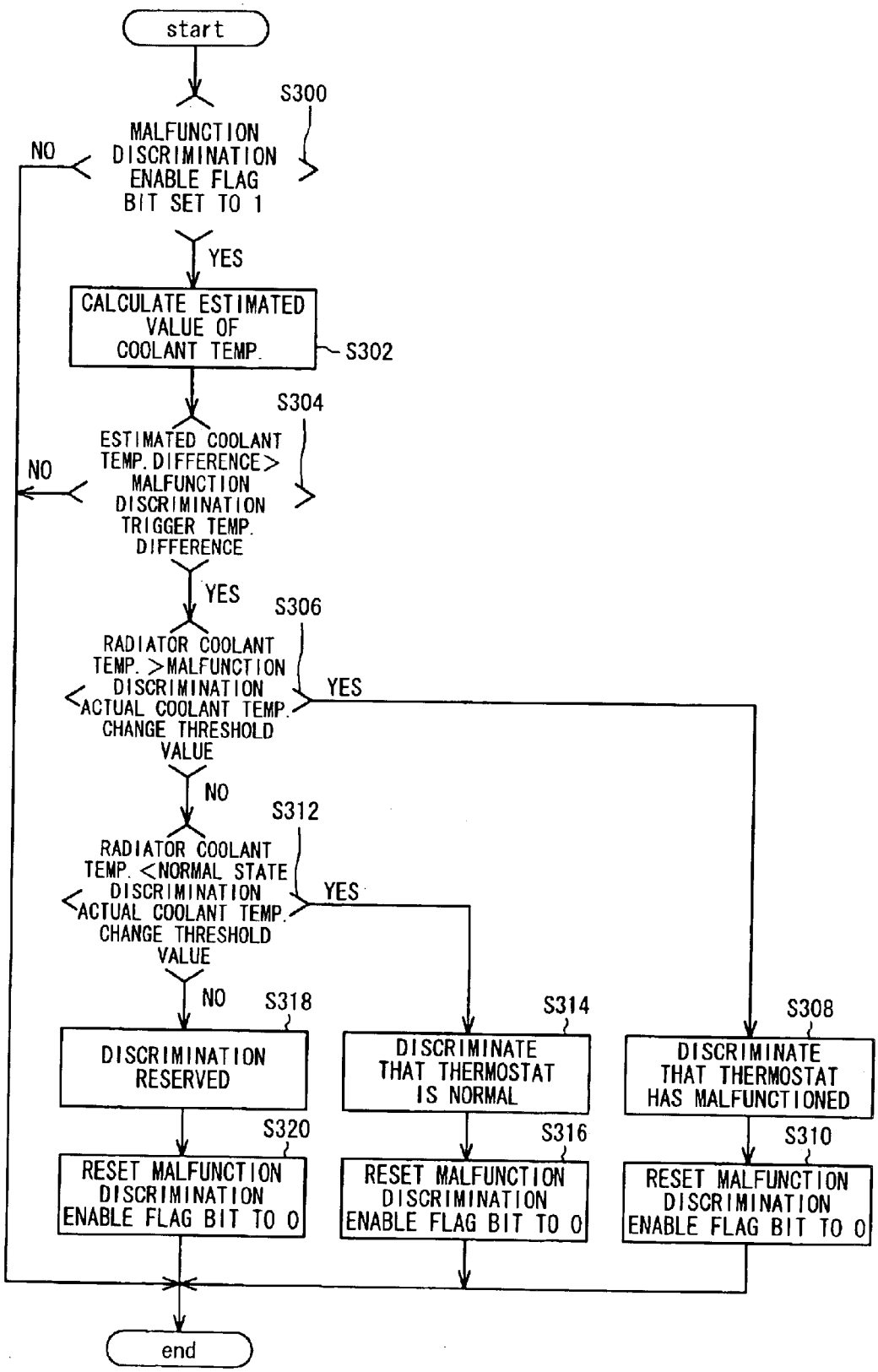
FIG. 8 is a flow chart for explaining another operations of the malfunction detecting system according to the second embodiment, which is conducted in parallel with the sequence of operations of the flow chart shown in FIG. 6.

FIG. 8 is a flow chart, similar to that of FIG. 5, for explaining a sequence of operations of the malfunction detecting system according to the second embodiment, which is conducted in parallel with the sequence of operations of the flow chart shown in FIG. 6.

In S300, it is checked whether the bit of the aforesaid flag is set to 1. When the result is No, the remaining steps are skipped, and when it is Yes, the calculation for estimating the coolant temperature TW is performed in S302. The calculation is done in the same manner as in the first embodiment, i.e., by the technique taught in the assignee's Japanese Laid-Open Patent Publication No. 2000-008853.

Next, in S304, it is checked whether the estimated coolant temperature difference exceeds the malfunction discrimination trigger temperature difference, i.e., the malfunction discrimination trigger temperature difference A or B selected in the flow chart of FIG. 6. When the result is No, it is determined not to conduct malfunction discrimination and the ensuing steps are skipped. When it is Yes, a check is made in S306 as to whether the detected radiator coolant temperature exceeds a malfunction discrimination actual coolant temperature change (malfunction discrimination threshold value).

When the result in S306 is Yes, it is discriminated or judged in S308 that the cooling apparatus (radiator) 60 has malfunctioned, more specifically that the thermostat 64 has malfunctioned, still more specifically that the thermostat 64 is stuck open. Next, in S310, the bit of the malfunction discrimination enable flag is reset to 0 and the ensuing processing is skipped.

When the result in S306 is No, it is checked in S312 whether the detected radiator coolant temperature TR is lower than a normal state discrimination actual coolant temperature change threshold value (see FIG. 7). When the result is Yes, it is then discriminated or judged in S314 that the cooling apparatus (radiator) is normal, more specifically that the thermostat 64 is normal, whereafter the bit of the aforesaid flag is reset to 0 in S316.

When the result in S312 is No, discrimination or judgment regarding malfunction is reserved in S318 for the same reason as explained with reference to the first embodiment, and the bit of the aforesaid flag is reset to 0 in S320.

As explained in the foregoing, this second embodiment is configured to detect the standing time period of the engine 10, determine whether to allow or disallow malfunction discrimination based on the detected value, and, when malfunction discrimination is allowed, to select as the malfunction discrimination trigger temperature difference (malfunction discrimination execute threshold value) either A or B in accordance with detected standing time period. This will be explained further with reference to FIG. 7. Taking the completely cooled state as a reference point, the malfunction discrimination should properly be conducted at time point t1. In the semi-cooled state, however, the estimated coolant temperature becomes high, so that if only one malfunction discrimination trigger temperature difference is set, malfunction discrimination comes to be conducted before t1, namely, at t2.

Owing to the foregoing configuration, however, the second embodiment enables the malfunction discrimination to be carried out an appropriate time point. Since the state of engine 10 cooling can therefore be accurately detected, the cooling apparatus (radiator) 60 can be diagnosed for malfunction with high precision.

The first and second embodiments are thus arranged to have a system for detecting malfunction of an engine cooling apparatus constituted as a radiator 60 having a communicating passage connected to an internal combustion engine 10 in such a manner that coolant flows in the radiator to be cooled and a thermostat 64 opening/closing the communicating passage, comprising: engine operation parameter obtaining means (ECU 20, temperature sensors 32, 78 etc.) for obtaining parameters indicating operating conditions of the engine, including at least a temperature of the coolant (TW) of the engine; estimated coolant temperature calculating means (ECU 20, S102, S302) for calculating an estimated temperature of the coolant after engine starting based on at least the detected coolant temperature at engine starting and a thermal load parameter correlated to rise in the coolant temperature after engine starting from among of the obtained parameters indicating the operating conditions of the engine; engine standing time period detecting means (ECU 20, S10, S200) for detecting a standing time period (TS) during which the engine was inoperative prior to the starting; threshold value selecting means (ECU 20, S12, S18, S20, S26, S202, S208, S210, S216) for comparing the detected standing time period with a predetermined time period (TREF2) and for selecting at least one of a plurality of preset threshold values including a malfunction discrimination threshold value (malfunction discrimination threshold value A or B; malfunction discrimination trigger temperature difference (malfunction discrimination execute threshold value) A or B) based on a result of comparison; and malfunction discriminating means (ECU 20, S100 to S120, S300 to S320) for discriminating whether the cooling apparatus has malfunctioned based on the selected threshold value and at least one of the estimated coolant temperature and the detected coolant temperature.

Thus, the malfunction detecting system of an engine cooling apparatus is configured to detect the standing time period during which the engine was inoperative before starting and compare it with the predetermined time period, select among preset multiple threshold values based on the result of the comparison, and discriminate malfunction of the cooling apparatus based on the selected threshold value and at least one of the estimated coolant temperature and the detected coolant temperature. Since this enables the state of engine cooling to be accurately determined, malfunction discrimination can be achieved with high accuracy.

In the system, malfunction discriminating means includes: first temperature comparing means (ECU 20, S104) for comparing at least one of the estimated coolant temperature and a difference between the estimated coolant temperature and the detected coolant temperature, more specifically, a difference between the estimated coolant temperature and the detected coolant temperature with the threshold value (malfunction discrimination threshold value A or B); and discriminates that the cooling apparatus has malfunctioned, when at least one of the estimated coolant temperature and the difference exceeds the threshold value (S106).

Thus, the selected threshold value is the malfunction discrimination value and the malfunction detecting system of an engine cooling apparatus is configured to compare at least one of the estimated value of the coolant temperature and the difference between the estimated and detected values of the coolant temperature with the selected malfunction discrimination threshold value and judge that the cooling apparatus has malfunctioned when the at least one value exceeds the selected threshold value. In other words, the discrimination threshold value used for the comparison is changed depending on the state of engine cooling, so that the threshold value enabling high-accuracy discrimination can be set to achieve still more accurate discrimination of cooling apparatus malfunction.

In the system, the malfunction discriminating means includes: first temperature comparing means (ECU 20, S304) for comparing the estimated coolant temperature with the threshold value (malfunction discrimination trigger temperature difference A or B); and second temperature comparing means (ECU 20, S306) for comparing the detected coolant temperature with a second threshold value (malfunction discrimination actual coolant temperature change threshold value), when the estimated coolant temperature exceeds the threshold value; and discriminates that the cooling apparatus has malfunctioned, when the detected coolant exceeds the second threshold value (S308).

Thus, the malfunction detecting system of an engine cooling apparatus is configured to compare the detected value of the coolant temperature with the malfunction discrimination threshold value when the estimated value of the coolant temperature exceeds the selected malfunction discrimination threshold value and judge that the cooling apparatus has malfunctioned when the detected value of the coolant temperature exceeds the malfunction discrimination threshold value. In other words, whether or not to execute malfunction discrimination is determined based on the state of engine cooling, so that the malfunction discrimination time point can be suitably determined to achieve still more accurate discrimination of cooling apparatus malfunction.

The system further includes: malfunction discrimination prohibiting means (ECU 20, S12, S14, S202, S204) for comparing the standing time period with a predetermined second time period (TREF1) and for prohibiting malfunction discrimination when the standing time period does not exceed the predetermined second time period.

Thus, the malfunction detecting system of an engine cooling apparatus is configured to further compare the standing time period with the second predetermined time period and prohibit malfunction discrimination when the standing time period does not exceed the second predetermined time period. This arrangement enables still more accurate discrimination of cooling apparatus malfunction by ensuring that malfunction discrimination is not carried out when the engine has not cooled.

In the system, the coolant temperature is a temperature of the coolant (TW) recirculating the engine 10, or the coolant temperature is a temperature of the coolant (TR) recirculating the radiator 60.

Thus, the coolant temperature is either the temperature of coolant circulating through the engine or the temperature of coolant circulating through the cooling apparatus, whereby the same advantages as set out above.

More specifically, the first embodiment is arranged to have a system for detecting malfunction of an engine cooling apparatus constituted as a radiator 60 having a communicating passage connected to an internal combustion engine 10 in such a manner that coolant flows in the radiator 60 to be cooled and a thermostat 64 opening/closing the communicating passage, comprising: engine operation parameter obtaining means (ECU 20, temperature sensor 32, etc.) for obtaining parameters indicating operating conditions of the engine, including at least a temperature of the coolant of the engine (TW); estimated coolant temperature calculating means (ECU 20, S102) for calculating an estimated temperature of the coolant after engine starting based on at least the detected coolant temperature at engine starting and a thermal load parameter correlated to rise in the coolant temperature after engine starting from among of the obtained parameters indicating the operating conditions of the engine; engine standing time period detecting means (ECU 20, S10) for detecting a standing time period (TS) during which the engine was inoperative prior to the starting; malfunction discrimination prohibiting means (ECU 20, S12, S14) for comparing the standing time period with a predetermined first time period (TREF1) and for prohibiting malfunction discrimination when the standing time period does not exceed the predetermined first time period; threshold value selecting means (ECU 20, S18, 20, S26) for comparing the detected standing time period with a predetermined second time period (TREF2) and for selecting at least one of a plurality of preset malfunction discrimination threshold values (A, B) based on a result of comparison; temperature comparing means (ECU 20, S104) for comparing at least one of the estimated coolant temperature and a difference between the estimated coolant temperature and the detected coolant temperature with the selected malfunction discrimination threshold value; and malfunction discriminating means (ECU 20, S106) for discriminating that the cooling apparatus has malfunctioned, when at least one of the estimated coolant temperature and the difference exceeds the selected malfunction discrimination threshold value.

The system further includes: second temperature comparing means (ECU 20, S110) for comparing the detected coolant temperature with a malfunction discrimination execute threshold value (malfunction discrimination trigger temperature); and third temperature comparing means (ECU 20, S112) for comparing at least one of the detected coolant temperature and a difference between the detected coolant temperature and the estimated coolant temperature with a normal state discrimination threshold value, when the detected coolant temperature exceeds the malfunction discrimination execute threshold value; and the malfunction discriminating means discriminates that the cooling apparatus is normal when at least one of the detected coolant temperature and the difference exceeds the normal state discrimination threshold value, whilst reserves the discrimination when at least one of the detected coolant temperature and the difference does not exceed the normal state discrimination threshold value (S114, S118). The coolant temperature is a temperature of the coolant (TW) recirculating the engine.

More specifically, the second embodiment is arranged to have a system for detecting malfunction of an engine cooling apparatus constituted as a radiator 60 having a communicating passage connected to an internal combustion engine 10 in such a manner that coolant flows in the radiator to be cooled and a thermostat 64 opening/closing the communicating passage, comprising: engine operation parameter obtaining means (ECU 20, temperature sensor 78 etc.) for obtaining parameters indicating operating conditions of the engine, including at least a temperature of the coolant of the engine; estimated coolant temperature calculating means (ECU 20, S302) for calculating an estimated temperature of the coolant after engine starting based on at least the detected coolant temperature at engine starting and a thermal load parameter correlated to rise in the coolant temperature after engine starting from among of the obtained parameters indicating the operating conditions of the engine; engine standing time period detecting means (ECU 20, S200) for detecting a standing time period (TS) during which the engine was inoperative prior to the starting; malfunction discrimination prohibiting means (ECU 20, S202, S204) for comparing the standing time period with a predetermined first time period (TREF1) and for prohibiting malfunction discrimination when the standing time period does not exceed the predetermined first time period; threshold value selecting means (ECU 20, S208, S210, S216) for comparing the detected standing time period with a predetermined second time period (TREF2) and for selecting at least one of a plurality of preset malfunction discrimination threshold values (malfunction discrimination trigger temperature differences A, B) based on a result of comparison; temperature comparing means (ECU 20, S304) for comparing the estimated coolant temperature with the selected malfunction discrimination threshold value; and malfunction discriminating means (ECU 20, S308) for discriminating that the cooling apparatus has malfunctioned, when the estimated coolant temperature exceeds the selected malfunction discrimination threshold value.

The system further includes: second temperature comparing means (ECU 20, S306) for comparing the detected coolant temperature with a second malfunction discrimination threshold value (malfunction discrimination actual coolant temperature change threshold value); and third temperature comparing means (ECU 20, S312) for comparing the detected coolant temperature with a normal state discrimination threshold value (normal state discrimination actual coolant temperature change threshold value), when the detected coolant temperature exceeds the second malfunction discrimination threshold value; and the malfunction discriminating means discriminates that the cooling apparatus is normal when the detected coolant temperature does not exceed the normal state discrimination threshold value, whilst reserves the discrimination when the detected coolant temperature exceeds the normal state discrimination threshold value (S314, S318). The coolant temperature is a temperature of the coolant (TR) recirculating the radiator.

It should be noted that the radiator 60 is not limited to the structure shown in FIG. 2. For example, the thermostat 64 can instead be installed on the side of the outlet pipe 74. In this case, the temperature sensor 78 is preferably installed on the side of the outlet pipe 74.

It should also be noted that, although the coolant temperature is estimated by the technique taught in the assignee's Japanese Laid-Open Patent application No. 2000-008853, no limitation to use of this technique is intended and any of various other methods that enable the rise in the coolant temperature TW to be estimated from the thermal load or the like can be appropriately adopted instead. At any rate, the point of this invention is to accurately detect the state of engine cooling and, in response thereto, to select a threshold value for malfunction discrimination or malfunction discrimination execution. The values to be compared with are therefore not limited to those shown but can be variously modified.

The entire disclosure of Japanese Patent Application No. 2003-067909 filed on Mar. 13, 2003, including specification, claims, drawings and summary, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A system for detecting malfunction of an engine cooling apparatus constituted as a radiator having a communicating passage connected to an internal combustion engine in such a manner that coolant flows in the radiator to be cooled and a thermostat opening/closing the communicating passage, comprising:

engine operation parameter obtaining means for obtaining parameters indicating operating conditions of the engine, including at least a temperature of the coolant of the engine;

estimated coolant temperature calculating means for calculating an estimated temperature of the coolant after engine starting based on at least the detected coolant temperature at engine starting and a thermal load parameter correlated to rise in the coolant temperature after engine starting from among of the obtained parameters indicating the operating conditions of the engine;

engine standing time period detecting means for detecting a standing time period during which the engine was inoperative prior to the starting;

threshold value selecting means for comparing the detected standing time period with a predetermined time period and for selecting at least one of a plurality of preset threshold values based on a result of comparison; and malfunction discriminating means for discriminating whether the cooling apparatus has malfunctioned based on the selected threshold value and at least one of the estimated coolant temperature and the detected coolant temperature.

2. A system according to claim 1, wherein the malfunction discriminating means includes:

first temperature comparing means for comparing at least one of the estimated coolant temperature and a difference between the estimated coolant temperature and the detected coolant temperature with the threshold value;

and discriminates that the cooling apparatus has malfunctioned, when at least one of the estimated coolant temperature and the difference exceeds the threshold value.

3. A system according to claim 1, wherein the malfunction discriminating means includes:

first temperature comparing means for comparing the estimated coolant temperature with the threshold value; and second temperature comparing means for comparing the detected coolant temperature with a second threshold value, when the estimated coolant temperature exceeds the threshold value;

and discriminates that the cooling apparatus has malfunctioned, when the detected coolant exceeds the second threshold value.

4. A system according to claim 1, further including:

malfunction discrimination prohibiting means for comparing the standing time period with a predetermined second time period and for prohibiting malfunction discrimination when the standing time period does not exceed the predetermined second time period.

5. A system according to claim 1, wherein the coolant temperature is a temperature of the coolant recirculating the engine.

6. A system according to claim 1, wherein the coolant temperature is a temperature of the coolant recirculating the radiator.

7. A system for detecting malfunction of an engine cooling apparatus constituted as a radiator having a communicating passage connected to an internal combustion engine in such a manner that coolant flows in the radiator to be cooled and a thermostat opening/closing the communicating passage, comprising:

engine operation parameter obtaining means for obtaining parameters indicating operating conditions of the engine, including at least a temperature of the coolant of the engine;

estimated coolant temperature calculating means for calculating an estimated temperature of the coolant after engine starting based on at least the detected coolant temperature at engine starting and a thermal load parameter correlated to rise in the coolant temperature after engine starting from among of the obtained parameters indicating the operating conditions of the engine;

engine standing time period detecting means for detecting a standing time period during which the engine was inoperative prior to the starting;

malfunction discrimination prohibiting means for comparing the standing time period with a predetermined first time period and for prohibiting malfunction discrimination when the standing time period does not exceed the predetermined first time period;

threshold value selecting means for comparing the detected standing time period with a predetermined second time period and for selecting at least one of a plurality of preset malfunction discrimination threshold values based on a result of comparison;

temperature comparing means for comparing at least one of the estimated coolant temperature and a difference between the estimated coolant temperature and the detected coolant temperature with the selected malfunction discrimination threshold value; and malfunction discriminating means for discriminating that the cooling apparatus has malfunctioned, when at least one of the estimated coolant temperature and the difference exceeds the selected malfunction discrimination threshold value.

8. A system according to claim 7, further including:

second temperature comparing means for comparing the detected coolant temperature with a malfunction discrimination execute threshold value; and third temperature comparing means for comparing at least one of the detected coolant temperature and a difference between the detected coolant temperature and the estimated coolant temperature with a normal state discrimination threshold value, when the detected coolant temperature exceeds the malfunction discrimination execute threshold value;

and the malfunction discriminating means discriminates that the cooling apparatus is normal when at least one of the detected coolant temperature and the difference exceeds the normal state discrimination threshold value, whilst reserves the discrimination when at least one of the detected coolant temperature and the difference does not exceed the normal state discrimination threshold value.

9. A system according to claim 7, wherein the coolant temperature is a temperature of the coolant recirculating the engine.

10. A system for detecting malfunction of an engine cooling apparatus constituted as a radiator having a communicating passage connected to an internal combustion engine in such a manner that coolant flows in the radiator to be cooled and a thermostat opening/closing the communicating passage, comprising:

engine operation parameter obtaining means for obtaining parameters indicating operating conditions of the engine, including at least a temperature of the coolant of the engine;

estimated coolant temperature calculating means for calculating an estimated temperature of the coolant after engine starting based on at least the detected coolant temperature at engine starting and a thermal load parameter correlated to rise in the coolant temperature after engine starting from among of the obtained parameters indicating the operating conditions of the engine;

engine standing time period detecting means for detecting a standing time period during which the engine was inoperative prior to the starting;

malfunction discrimination prohibiting means for comparing the standing time period with a predetermined first time period and for prohibiting malfunction discrimination when the standing time period does not exceed the predetermined first time period;

threshold value selecting means for comparing the detected standing time period with a predetermined second time period and for selecting at least one of a plurality of preset malfunction discrimination threshold values based on a result of comparison;

temperature comparing means for comparing the estimated coolant temperature with the selected malfunction discrimination threshold value; and malfunction discriminating means for discriminating that the cooling apparatus has malfunctioned, when the estimated coolant temperature exceeds the selected malfunction discrimination threshold value.

11. A system according to claim 10, further including:

second temperature comparing means for comparing the detected coolant temperature with a second malfunction discrimination threshold value; and third temperature comparing means for comparing the detected coolant temperature with a normal state discrimination threshold value, when the detected coolant temperature exceeds the second malfunction discrimination threshold value;

and the malfunction discriminating means discriminates that the cooling apparatus is normal when the detected coolant temperature does not exceed the normal state discrimination threshold value, whilst reserves the discrimination when the detected coolant temperature exceeds the normal state discrimination threshold value.

12. A system according to claim 10, wherein the coolant temperature is a temperature of the coolant recirculating the radiator.

* * * * *